US007625261B2

(12) United States Patent
Andersen

(10) Patent No.: US 7,625,261 B2
(45) Date of Patent: Dec. 1, 2009

(54) TOY BUILDING SET

(75) Inventor: Henrik Andersen, Billund (DK)

(73) Assignee: Lego A/S, Billind (DK)

( * ) Notice: Subject to any disclaimer, the term of this patent is extended or adjusted under 35 U.S.C. 154(b) by 249 days.

(21) Appl. No.: 11/883,956

(22) PCT Filed: Feb. 8, 2006

(86) PCT No.: PCT/DK2006/000071

§ 371 (c)(1),
(2), (4) Date: Oct. 1, 2007

(87) PCT Pub. No.: WO2006/084465

PCT Pub. Date: Aug. 17, 2006

(65) Prior Publication Data

US 2008/0311819 A1 Dec. 18, 2008

(30) Foreign Application Priority Data

Feb. 9, 2005 (DK) ..... 2005 00192

(51) Int. Cl.
*A63H 33/08* (2006.01)

(52) U.S. Cl. ..... 446/124; 446/115; 446/120; 446/85

(58) Field of Classification Search ..... 446/18–122, 446/124, 125, 128
See application file for complete search history.

(56) References Cited

U.S. PATENT DOCUMENTS

| | | | | |
|---|---|---|---|---|
| 3,566,531 A | | 3/1971 | Hasel et al | |
| 3,657,838 A | * | 4/1972 | Hanning et al. | 446/126 |
| 4,185,410 A | * | 1/1980 | Kristiansen | 446/104 |
| 5,030,158 A | * | 7/1991 | Gal et al. | 446/128 |
| 5,928,051 A | * | 7/1999 | Krog | 446/104 |
| 5,964,635 A | | 10/1999 | Krog | |

* cited by examiner

*Primary Examiner*—Gene Kim
*Assistant Examiner*—Scott Young
(74) *Attorney, Agent, or Firm*—Day Pitney LLP

(57) ABSTRACT

A toy building set with toy building elements with coupling means for releasably interconnecting the toy building elements, which further comprises outer and inner toy building elements with a longitudinal direction. The inner toy building elements are receivable in the outer toy building elements, and the inner toy building elements are slideable in the outer toy building elements along their parallel longitudinal directions. The outer toy building elements can be interconnected in their longitudinal directions to form a composite outer toy building element, and the inner toy building elements can be interconnected in their longitudinal directions to form a composite inner toy building element that can be slideably received in the composite outer toy building element.

7 Claims, 1 Drawing Sheet

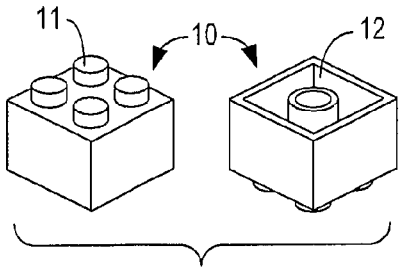
Fig. 1 - PRIOR ART
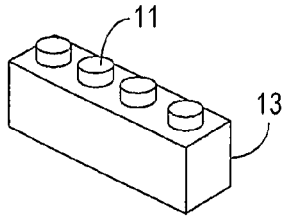
Fig. 2 - PRIOR ART
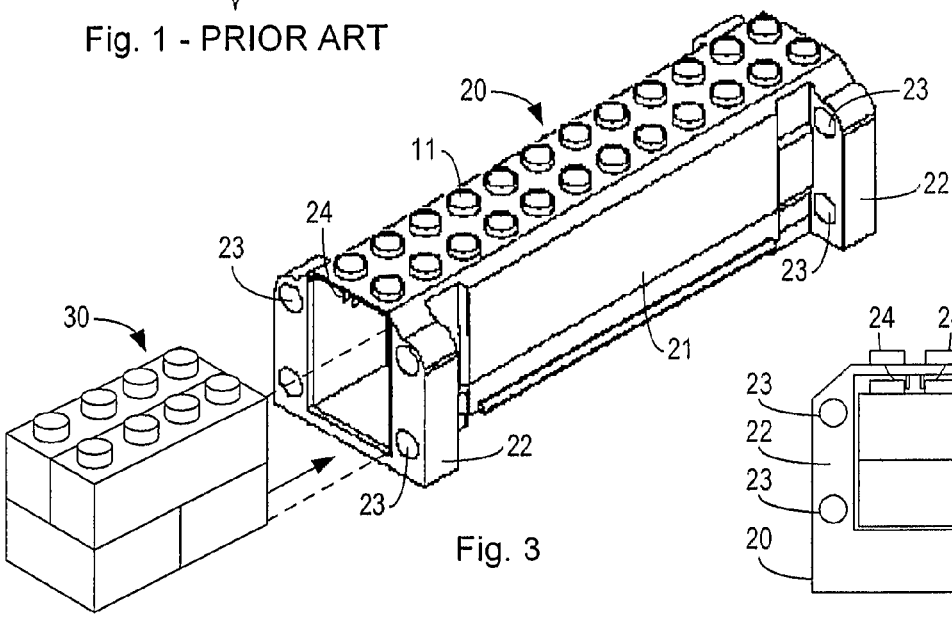
Fig. 3
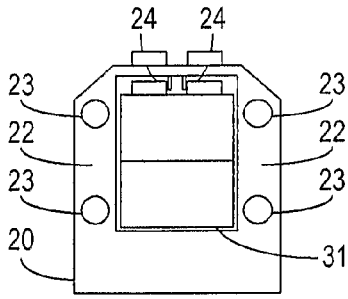
Fig. 4
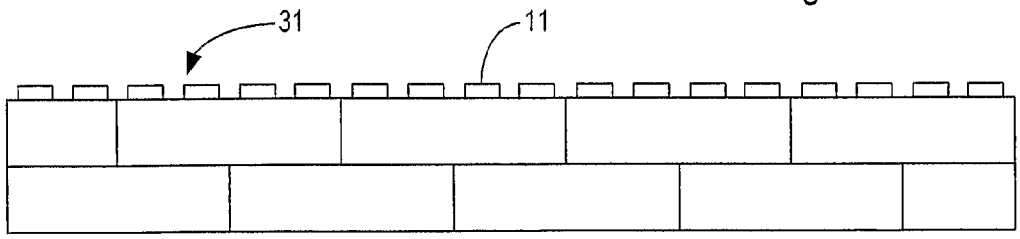
Fig. 5
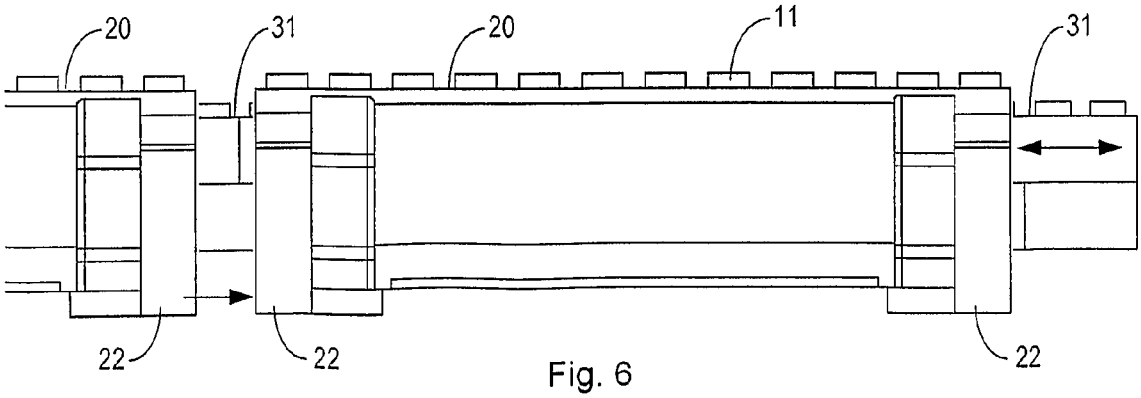
Fig. 6

TOY BUILDING SET

BACKGROUND OF THE INVENTION

The invention relates to toy building sets comprising toy building elements with coupling means for releasably interconnecting the toy building elements. Such toy building sets exist, and a great variety of constructions can be made out of the building elements of such building sets. General building elements with no or little degree of specialisation are suitable for building general constructions with a correspondingly low degree of specialisation. Specialised building elements are intended to resemble or simulate corresponding real life objects such as windows and doors for buildings or components of vehicles or other machinery. Such specialised building elements make it possible to build more realistic and life-like constructions with enhanced play value.

Specialised telescopic elements exist for use in e.g. toy cars for simulating crane arms that are extendable between fixed limits. Such specialised elements are usable only for building a limited number of models.

The object of the invention is to provide new telescopic toy building elements that are modular and versatile so that they can be used for several purposes and for building several models of different sizes.

SUMMARY OF THE INVENTION

The invention solves this problem by providing a toy building set with toy building elements with coupling means for releasably interconnecting the toy building elements, which further comprises outer and inner toy building elements with a longitudinal direction, where the inner toy building elements are receivable in the outer toy building elements, and the inner toy building elements are slideable in the outer toy building elements along their parallel longitudinal directions, wherein the outer toy building elements can be interconnected in their longitudinal directions to form a composite outer toy building element, and the inner toy building elements can be interconnected in their longitudinal directions to form a composite inner toy building element that can be slideably received in the composite outer toy building element.

With such a toy building set the user can build telescoping composite building elements of inner and outer toy building elements of any desired length.

The user can choose to build composite inner and outer composite toy building elements of equal lengths so that the composite inner toy building element can be fully received in the composite outer toy building element and be telescoped to almost twice the length of either one of the composite elements.

Or the user can choose to build composite inner and outer toy building elements of different lengths. With e.g. the composite inner toy building element longer than the outer composite toy building element, the inner one can be supported at its ends and the outer one can slide on the inner one.

BRIEF DESCRIPTION OF THE DRAWINGS

FIGS. 1 and 2 are perspective views showing prior art toy building elements, FIG. 3 is a perspective view showing an outer and an inner toy building element, FIG. 4 is an end view showing an inner toy building element received in an outer toy building element, FIG. 5 is a side view of a composite inner toy building element, and FIG. 6 is a side view of a composite inner toy building element received in a composite outer toy building element.

DETAILED DESCRIPTION OF THE INVENTION

In FIG. 1 is shown a prior art toy building element 10 in top view and in bottom view. The building element 10 has coupling studs 11 and a cavity 12 for receiving coupling studs 10 on another building element in a frictional engagement. Such toy building elements are disclosed in U.S. Pat. No. 3,005,282. In FIG. 2 is shown another prior art toy building element 13 also having coupling studs 11 and a (not shown) cavity opening to the opposite side.

In FIG. 3 is shown an outer toy building element 20 with coupling studs 11 on its top surface. Two parallel side walls 21 depending from the top wall extend in the longitudinal direction of the element, and the two opposed ends are open. At each end and on both sides the outer toy building element 20 has laterally extending flanges 22 with openings 23. Two or more aligned outer toy building elements 20 arranged end by end and can then be interconnected by means of pegs (not shown but known as such) snapped into aligned openings 23 in the adjacent flanges 22 of the two outer toy building elements.

FIG. 3 also shows a composite inner toy building element 30 composed of toy building elements of the type shown in FIGS. 1 and 2, and FIG. 5 shows another such composite inner toy building element 31. The composite inner toy building elements 30 and 31 can be received in the outer toy building element 20 as indicated in FIG. 3 and as shown in FIG. 4.

FIG. 6 shows two outer toy building elements 20 with the composite inner toy building element 31 received therein. The two outer toy building elements 20 are shown a small distance apart ready for being assembled to form a composite outer toy building element with their flanges 22 abutting as indicated by an arrow, and a peg is snap-fitted in each of the aligned openings 23 to hold them together.

Instead of using the flanges with holes for receiving pegs for assembling outer building elements 20, building elements as in FIG. 1, possibly with reduced height, can be used on top of the neighbouring outer elements and couple on the coupling studs 11 on both of them. The outer elements 20 may also have coupling cavities like the cavity 12 in FIG. 1 to receive coupling studs 11 of a building element below. The outer building elements 20 are then interconnected in a similar manner as the building elements in FIG. 5.

FIG. 4 shows two walls 24 depending from the top wall of the outer building element 20. The walls 24 touch the coupling studs 11 on the composite inner toy building element 31 in a frictional engagement, whereby the inner toy building element 31 is prevented from sliding out of the outer building element 20, due to gravity, if held in a vertical position.

The composite inner toy building elements 30 and 31 have two longitudinal rows of coupling studs 11. The toy building elements 13 in FIG. 2 have a single row of coupling studs 11, and such building elements can also be used for building composite inner toy building elements having a width only half of the width of the composite inner toy building element 30. The outer toy building elements 20 can then receive two or more such half-width composite inner toy building elements, which can then be moved independently in the outer building element and possibly be extended out of both ends of the outer element.

The invention claimed is:

1. A toy building set comprising toy building elements with coupling means for releasably interconnecting the toy building elements, the toy building set further comprising outer toy building elements (20) having a longitudinal direction and inner toy building elements (30) having a longitudinal direction, the inner toy building elements being receivable in the outer toy building elements with the longitudinal directions of the inner toy building elements parallel to the longitudinal directions of the outer toy building elements and the inner toy building elements slideable in the outer toy building elements along their parallel longitudinal directions, wherein the outer toy building elements can be interconnected in their longitudinal directions to form a composite outer toy building element, and the inner toy building elements can be interconnected in their longitudinal directions to form a composite inner toy building element comprising interconnections of the building elements, characterized in that the outer toy building elements (20), at opposite ends in their longitudinal direction, have flanges (22) extending transversely to the longitudinal direction, and the flanges have coupling means (23) for releasably interconnecting outer toy building elements (20).

2. A toy building set according to claim 1, characterized in that the coupling means on the flanges comprise longitudinally extending openings (23) for receiving a peg with means for snapping into aligned longitudinally extending openings of two adjacent outer toy building elements (20).

3. A toy building set according to claim 1, characterized in that the coupling means for releasably interconnecting the toy building elements comprise coupling studs (11) and coupling cavities (12) for receiving coupling studs, and the outer toy building elements have such coupling studs and coupling cavities.

4. A toy building set according to claim 1, characterized in that the coupling means for releasably interconnecting the toy building elements comprise coupling studs (11) and coupling cavities (12) for receiving coupling studs, and the inner toy building elements have such coupling studs and coupling cavities.

5. A toy building set according to claim 4, characterized in that the outer toy building elements have means (24) for frictional engagement with inner toy building elements when received therein.

6. A toy building set according to claim 5, characterized in that the means (24) for frictional engagement with inner toy building elements comprise a longitudinally extending wall (24) for engagement with coupling studs (11) on the inner toy building elements.

7. A toy building set according to claim 1 wherein the outer toy building elements (20) can receive two or more inner toy building elements (30) arranged side by side.

* * * * *